US009981828B2

(12) United States Patent
Vaunois et al.

(10) Patent No.: US 9,981,828 B2
(45) Date of Patent: May 29, 2018

(54) GUIDE DEVICE WITH GIB WEAR DETECTOR

(71) Applicants: OTIS ELEVATOR COMPANY, Farmington, CT (US); Eric Vaunois, Briare (FR); Bruno Quaretti, Nevoy (FR)

(72) Inventors: Eric Vaunois, Briare (FR); Bruno Quaretti, Gien (FR)

(73) Assignee: Otis Elevator Company, Farmington, CT (US)

( * ) Notice: Subject to any disclaimer, the term of this patent is extended or adjusted under 35 U.S.C. 154(b) by 0 days. days.

(21) Appl. No.: 15/100,797

(22) PCT Filed: Dec. 30, 2013

(86) PCT No.: PCT/IB2013/003187
§ 371 (c)(1),
(2) Date: Jun. 1, 2016

(87) PCT Pub. No.: WO2015/101801
PCT Pub. Date: Jul. 9, 2015

(65) Prior Publication Data

US 2016/0304315 A1 Oct. 20, 2016

(51) Int. Cl.

| | |
|---|---|
| ***B66B 1/34*** | (2006.01) |
| ***B66B 7/04*** | (2006.01) |
| ***B66B 5/00*** | (2006.01) |
| ***B66B 7/12*** | (2006.01) |

(52) U.S. Cl.
CPC ..... *B66B 7/047* (2013.01); *B66B 5/0025* (2013.01); *B66B 5/0031* (2013.01); *B66B 7/1246* (2013.01)

(58) Field of Classification Search
USPC ..... 187/393
See application file for complete search history.

(56) References Cited

U.S. PATENT DOCUMENTS

| | | | | |
|---|---|---|---|---|
| 3,593,266 | A | 7/1971 | Van Sickle | |
| 4,201,974 | A | 5/1980 | Fima | |
| 4,652,146 | A * | 3/1987 | Ellermann | B66B 7/047 187/409 |
| 4,984,659 | A | 1/1991 | Nomura | |
| 6,384,721 | B1 | 5/2002 | Paielli | |

(Continued)

FOREIGN PATENT DOCUMENTS

| | | |
|---|---|---|
| EP | 1101971 | 5/2001 |
| GB | 2221269 | 1/1990 |

(Continued)

*Primary Examiner* — Christopher Uhlir
(74) *Attorney, Agent, or Firm* — O'Shea Getz P.C.

(57) ABSTRACT

A guide device is operable to be connected to a hoisted object to aid in guiding the hoisted object relative to a guide member. The guide device includes a shoe, a gib, and a wear detector. The shoe is operable to be connected to the hoisted object. The gib is operable to be connected to the shoe. The gib is operable to contact the guide member when the hoisted object is moved relative to the guide member. The gib is operable to experience an amount of wear as a result of the contact between the gib and the guide member. The wear detector is disposed relative to the gib and the guide member. The wear detector is operable to detect when the amount of wear experienced by the gib reaches a predetermined threshold.

20 Claims, 5 Drawing Sheets

(56) References Cited

U.S. PATENT DOCUMENTS

| | | | | |
|---|---|---|---|---|
| 7,328,607 | B2 | 2/2008 | Pfeffer | |
| 7,398,863 | B2 * | 7/2008 | Liebetrau | B66B 7/046 187/367 |
| 7,686,140 | B2 * | 3/2010 | Rossignol | B66B 7/062 187/393 |
| 7,909,145 | B2 | 3/2011 | Erny et al. | |
| 8,011,481 | B2 | 9/2011 | Erny et al. | |
| 8,016,081 | B2 | 9/2011 | Weinberger et al. | |
| 8,104,586 | B2 * | 1/2012 | Traktovenko | B66B 1/3476 187/277 |
| 9,102,476 | B2 * | 8/2015 | Musick | B65G 17/086 |
| 2011/0036667 | A1 | 2/2011 | Ueda et al. | |
| 2011/0132696 | A1 | 6/2011 | Dorsch et al. | |
| 2011/0169651 | A1 * | 7/2011 | Mitchell | F04C 14/00 340/679 |
| 2012/0248929 | A1 * | 10/2012 | Fish | H01R 39/58 310/248 |
| 2013/0015315 | A1 | 1/2013 | Hoffend, III et al. | |
| 2014/0246275 | A1 * | 9/2014 | Korvenranta | B66B 11/0476 187/254 |

FOREIGN PATENT DOCUMENTS

| | | |
|---|---|---|
| JP | 05294583 | 11/1993 |
| JP | 09071372 | 3/1997 |
| JP | 2001199654 | 7/2001 |
| JP | 2005330051 | 12/2005 |
| JP | 2011144026 | 7/2011 |

* cited by examiner

GUIDE DEVICE WITH GIB WEAR DETECTOR

This application claims priority to PCT Patent Application No. PCT/IB2013/003187 filed Dec. 30, 2013, which is hereby incorporated herein by reference in its entirety.

BACKGROUND

1. Technical Field

Aspects of the present invention relate to a guide device that is operable to aid in guiding a hoisted object relative to a guide member, and more particularly relate to such a guide device wherein the guide device includes a gib wear detector.

2. Background Information

Hoisting systems (e.g., elevator systems, crane systems) often include a hoisted object (e.g., an elevator car), a counterweight, a tension member (e.g., a rope, a belt) that connects the hoisted object and the counterweight, and a sheave that contacts the tension member. During operation of such hoisting systems, the sheave can be selectively driven (e.g., by a machine) to selectively move the hoisted object and the counterweight. Hoisting systems also often include a guide device that is connected to the hoisted object, and that is operable to aid in guiding the hoisted object relative to a guide member (e.g., a rail). In some instances, the guide device includes a gib and a shoe. The gib is connected to the shoe. The shoe is connected to the hoisted object. The gib is operable to contact at least a portion of the guide member (e.g., the rail) when the hoisted object is moved relative to the guide member. The gib is operable to experience an amount of wear as a result of such contact. In such instances, it can be difficult to determine the amount of wear experienced by the gib. For example, it can be necessary to at least partially disassemble the hoisting system, or a component thereof, to determine (e.g., by visual inspection) the amount of wear experienced by the gib. As such, it can be difficult or impossible to detect when the amount of wear experienced by the gib reaches a predetermined threshold. This can be problematic, because after the amount of wear experienced by the gib reaches the predetermined threshold, it is possible that the shoe will contact the guide member when the hoisted object is moved relative to the guide member. In some instances, such contact between the shoe and the guide member can cause catastrophic damage to the shoe, the guide member, and/or one or more other components of the hoisting system. Aspects of the present invention are directed to these and other problems.

SUMMARY OF ASPECTS OF THE INVENTION

According to an aspect of the present invention, a guide device is operable to be connected to a hoisted object to aid in guiding the hoisted object relative to a guide member. The guide device includes a shoe, a gib, and a wear detector. The shoe is operable to be connected to the hoisted object. The gib is operable to be connected to the shoe. The gib is operable to contact the guide member when the hoisted object is moved relative to the guide member. The gib is operable to experience an amount of wear as a result of the contact between the gib and the guide member. The wear detector is disposed relative to the gib and the guide member. The wear detector is operable to detect when the amount of wear experienced by the gib reaches a predetermined threshold.

An elevator guidance wear monitoring system is provided that includes a slide guide. The slide guide is configured to be operatively mounted to an elevator car, and to selectively contact a guide rail during movement of the elevator car in a hoistway. The slide guide includes a sacrificial liner and a wear monitor. The sacrificial liner is configured to wear during movement of the elevator car. The wear monitor is configured to identify when wear of the sacrificial liner has reached a predetermined threshold.

An elevator sliding guide is provided that includes a gib and a wear monitoring system. The gib is configured to wear away due to sliding contact with a guide rail. The wear monitoring system is configured to provide an electronic indication when the gib has worn away to a predetermined threshold.

Additionally or alternatively, aspects of the present invention may include one or more of the following features individually or in combination:

- the hoisted object is an elevator car;
- the guide member is a rail;
- the gib is operable to contact an electrically conductive portion of the guide member;
- the gib defines a gib channel that is configured to receive a portion of the guide member;
- the gib is made at least partially of a plastic material;
- the gib is electrically non-conductive;
- the shoe does not contact the guide member during normal operation;
- the wear detector includes a first electrical conductor, a second electrical conductor, and a controller that is operable to send and receive electrical signals via the first electrical conductor and the second electrical conductor;
- the controller is operable to detect when the amount of wear experienced by the gib reaches the predetermined threshold by sensing a presence of an electrical connection between the first electrical conductor and the second electrical conductor;
- the controller is operable to detect when the amount of wear experienced by the gib reaches the predetermined threshold by sensing that a closed circuit has been formed at least partially by the first electrical conductor and the second electrical conductor;
- the controller is operable to detect when the amount of wear experienced by the gib reaches the predetermined threshold by sensing an absence of an electrical connection between the first electrical conductor and the second electrical conductor;
- the controller is operable to detect when the amount of wear experienced by the gib reaches the predetermined threshold by sensing that an open circuit has been formed at least partially by the first electrical conductor and the second electrical conductor;
- the first electrical conductor includes a first terminal embedded within the gib and a first wire that extends between the first terminal and the controller;
- the gib defines a gib channel that is configured to receive an electrically conductive portion of the guide member, and the first terminal is embedded within the gib such that, when the gib is in a new condition, a section of the gib extends between the first terminal and a surface of the gib that at least partially defines the gib channel;
- the first electrical conductor includes a sacrificial portion that is operable to contact the guide member and enable an electrical connection between the first electrical conductor and the second electrical conductor until the sacrificial portion and the gib experience an amount of wear that reaches the predetermined threshold;

the second electrical conductor includes a second terminal that is connected to the guide member, and the gib is operable to contact an electrically conductive portion of the guide member;

the second electrical conductor includes a second terminal embedded within the gib and a second wire that extends between the second terminal and the controller, and the wear detector includes an electrically conductive sacrificial element that enables an electrical connection between the first electrical conductor and the second electrical conductor until the sacrificial element and the gib experience an amount of wear that reaches the predetermined threshold;

the wear detector is operable to provide a wear threshold signal to indicate that the wear detector has detected that the predetermined threshold has been reached;

the wear detector is operable to provide a wear threshold signal to a braking device that is operable to stop movement of the hoisted object in response to the wear threshold signal;

the wear detector is operable to provide a wear threshold signal to a warning device that is operable to warn a person that the predetermined threshold has been reached;

the wear monitor is an electrical monitor that includes a plurality of electrodes;

the wear monitor is connected to a remote system through an internet-based system; and the wear monitoring system includes a plurality of electrodes, and the electronic indication is provided based on a quality of electrical contact between the plurality of electrodes.

These and other aspects of the present invention will become apparent in light of the drawings and detailed description provided below.

DETAILED DESCRIPTION OF ASPECTS OF THE INVENTION

Figure 1:
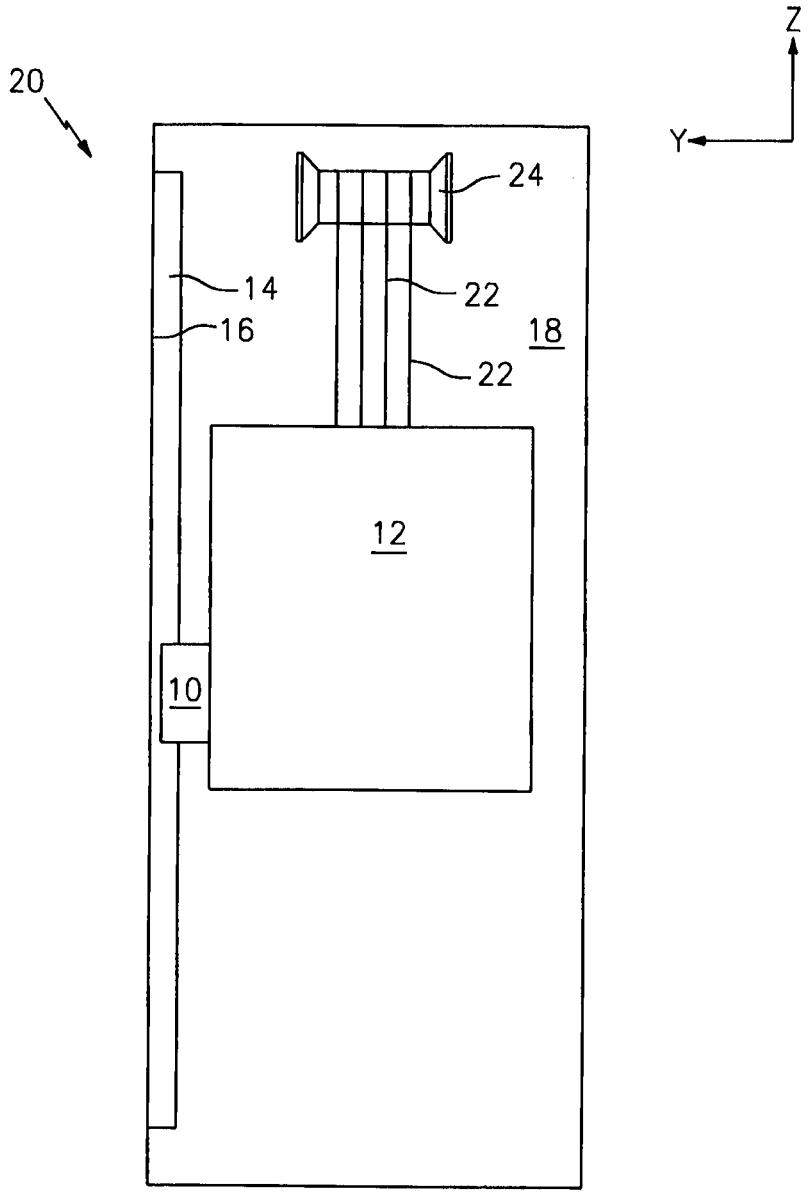
FIG. 1 illustrates a schematic view of a hoisting system that includes an exemplary embodiment of the present guide device, which is operable to aid in guiding an elevator car relative to a rail.

Referring to FIGS. 1-4, the present disclosure describes embodiments of a guide device 10 that is operable to be connected to a hoisted object 12 (see FIG. 1), and operable to aid in guiding the hoisted object 12 relative to a guide member 14. The present disclosure describes aspects of the present invention with reference to the embodiments illustrated in the drawings; however, aspects of the present invention are not limited to the embodiments illustrated in the drawings. The present disclosure may describe one or more features as having a length extending along an x-axis, a width extending along a y-axis, and/or a height extending along a z-axis. The drawings illustrate the respective axes.

The guide device 10 can be used with various types of hoisted objects 12 (e.g., elevator cars, counterweights) and various types of guide members 14 (e.g., rails). Referring to FIG. 1, in the illustrated embodiment, the hoisted object 12 is an elevator car, and the guide member 14 is a rail that is connected to a sidewall 16 of a hoistway 18. For ease of description, the hoisted object 12 and the guide member 14 will be referred to hereinafter as the "elevator car 12" and the "rail 14", respectively.

The elevator car 12 can be configured within a hoisting system 20 in various different ways. Referring to FIG. 1, in the illustrated embodiment, the elevator car 12 is connected to a counterweight (not shown) by a plurality of tension members 22, and the tension members 22 contact a sheave 24 that is operable to be selectively driven by a machine (not shown) to selectively move the elevator car 12 and the counterweight within the hoistway 18.

Figure 2:
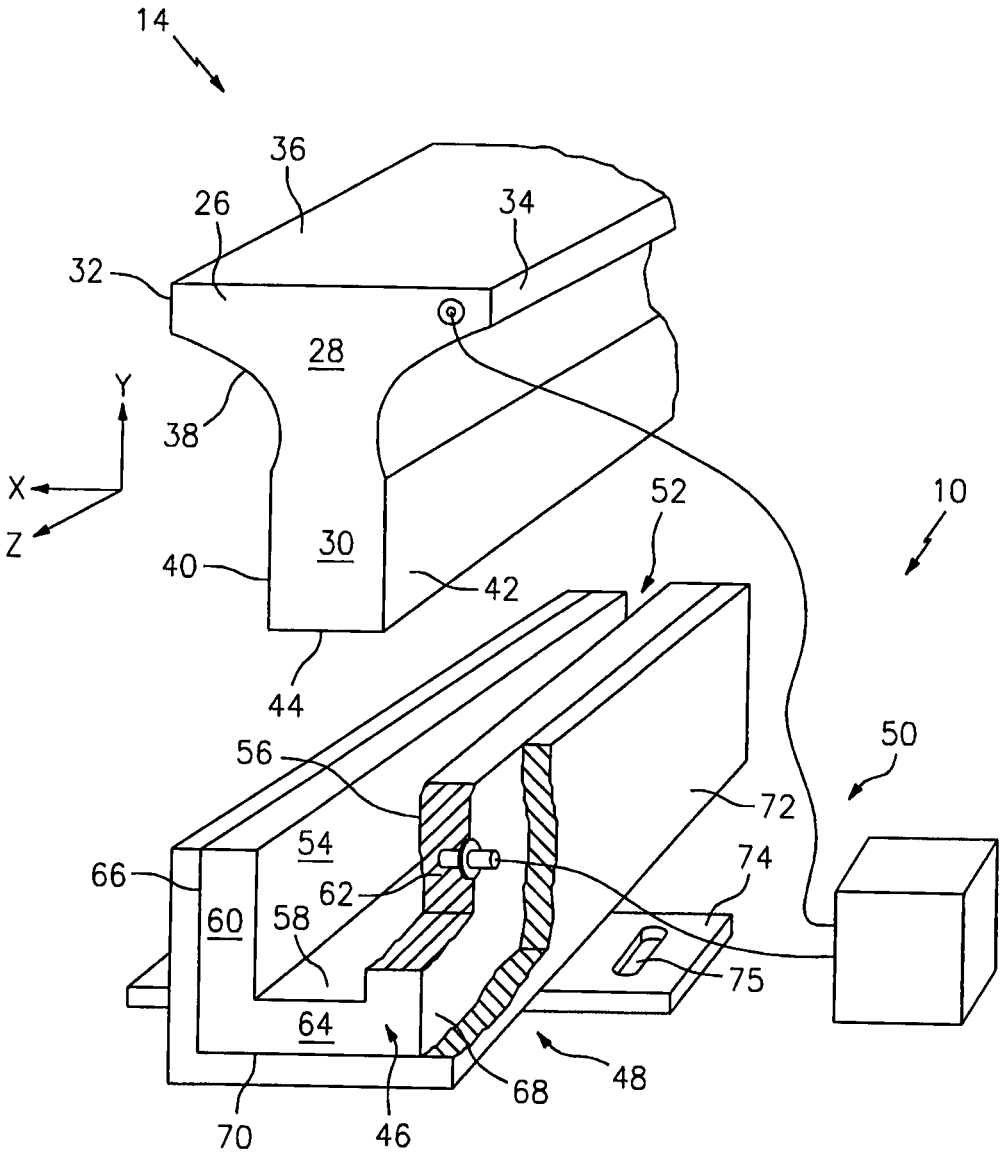
FIG. 2 illustrates an exploded perspective view of the guide device and the rail of FIG. 1.

The rail 14 can be configured in various different ways. Referring to FIG. 2, in the illustrated embodiment, the rail 14 extends in a heightwise direction between a top end surface 26 and a bottom end surface (not shown). The rail 14 includes a flange 28 and a web 30 that are disposed relative to one another such that the rail 14 is generally T-shaped in an x-y cross-sectional plane. The flange 28 includes a first side surface 32, a second side surface 34, a third side surface 36, and a fourth side surface 38. The first and second side surfaces 32, 34 of the flange 28 each extend in a widthwise direction between the third and fourth side surfaces 36, 38 of the flange 28. The third side surface 36 of the flange 28 is connected to the sidewall 16 of the hoistway 18 (see FIG. 1). The web 30 extends from the fourth side surface 38 of the flange 28 in a widthwise direction. The web 30 includes a first side surface 40, a second side surface 42, and a third side surface 44. The first, second, and third side surfaces 40, 42, 44 of the web 30 are disposed relative to one another such that the web 30 is generally rectangular-shaped in a x-y cross-sectional plane. The third side surface 44 of the web 30 extends in a lengthwise direction between the first and second side surfaces 40, 42 of the web 30. In other embodiments, can have other geometries that are roughly "T" shaped. In some of these embodiments, the rail 14 can have rectangular, curved, and/or non-symmetric portions. These portions can be configured to correspond to similar contours of a gib 46, a shoe 48, and/or a slide guide.

The rail 14 can be made from various materials or combinations of materials. Examples of acceptable materials include: steel, aluminum, and combinations thereof. Material(s) of the rail 14 can be selected such that at least a portion of the rail 14 is electrically conductive. Additionally or alternatively, material(s) of the rail 14 can be selected such that at least a portion of the rail 14 is electrically non-conductive.

Figure 3:
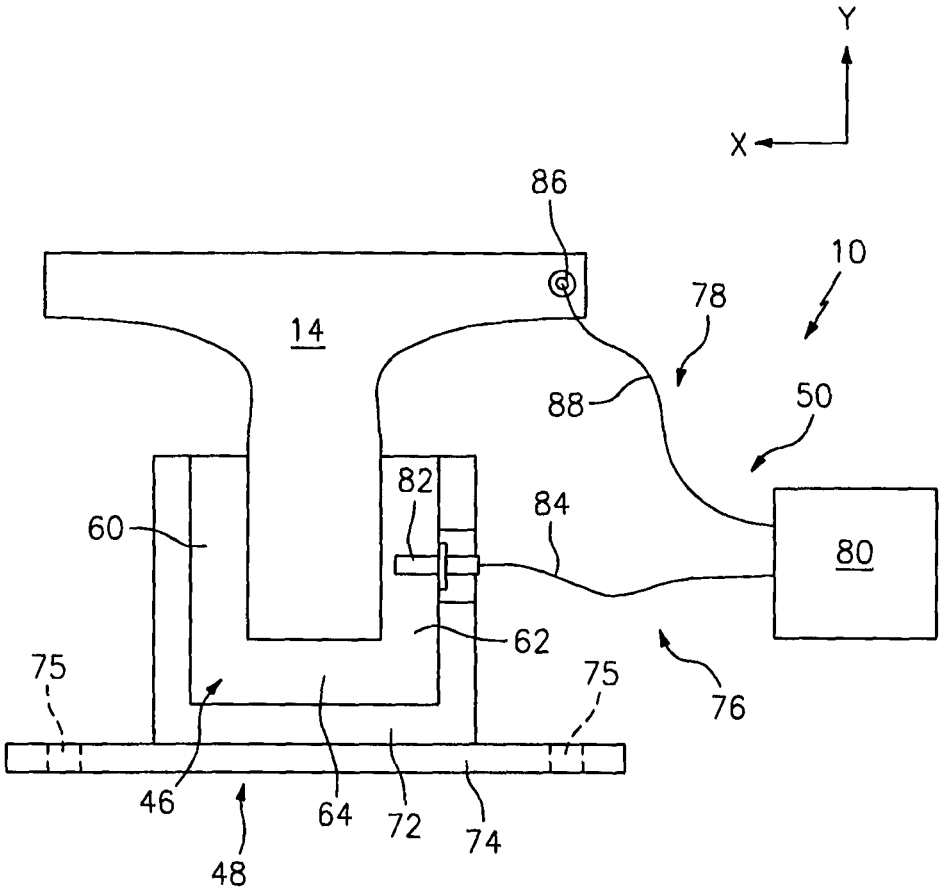
FIG. 3 illustrates a sectional elevation view of the guide device and the rail of FIG. 1.
Figure 4:
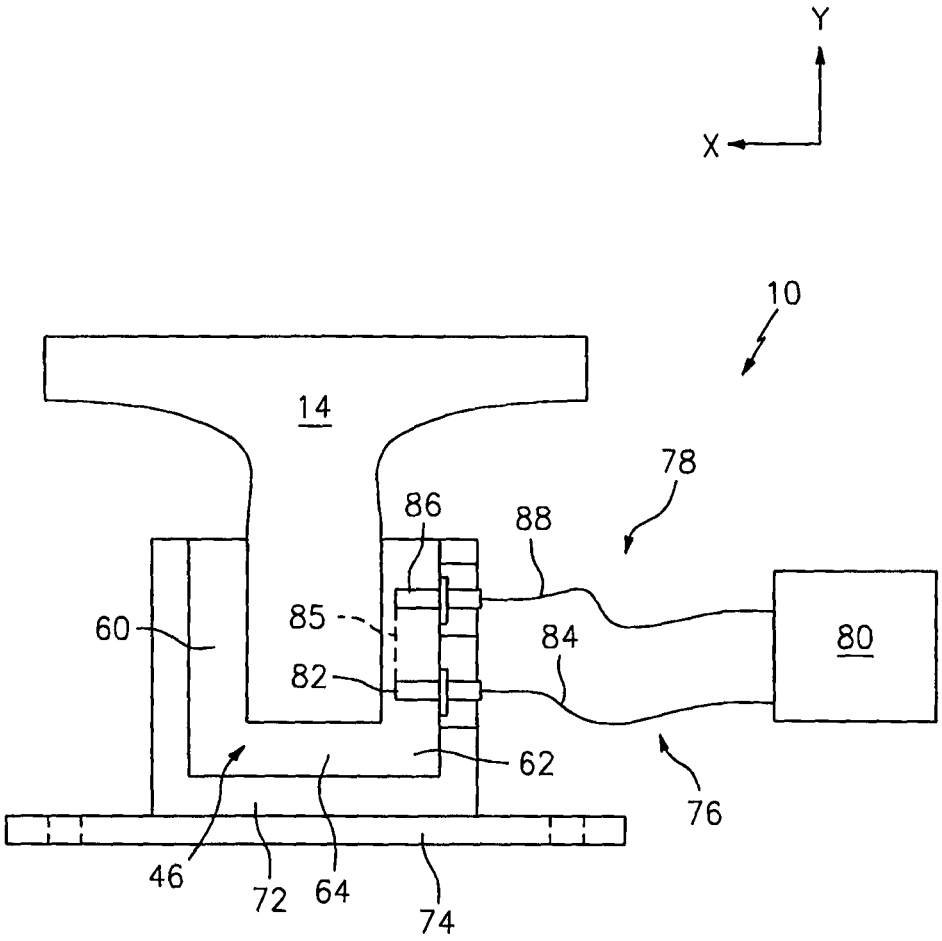
FIG. 4 illustrates a sectional elevation view of another guide device disposed relative to a rail.

Referring to FIGS. 2-4, the guide device 10 includes a gib 46, a shoe 48, and a wear detector 50. The gib 46 is operable to be connected to the shoe 48, and the shoe 48 is operable to be operatively connected to the hoisted object 12 (see FIG. 1). The gib 46 is operable to contact at least a portion of the rail 14 when the elevator car 12 is moved relative to the rail 14, and the gib 46 is operable to experience an amount of wear as a result of such contact. This contact can be constant or intermittent. The wear detector 50 is disposed relative to the gib 46 and the rail 14, and is operable to detect when the amount of wear experienced by the gib 46 reaches a predetermined threshold.

The gib 46 can be configured in various different ways. Referring to FIG. 2, in the illustrated embodiment, the gib 46 defines a gib channel 52 that is configured to receive the web 30 of the rail 14. The gib channel 52 is defined by a first channel surface 54 that is operable to contact the first side surface 40 of the web 30, a second channel surface 56 that is operable to contact the second side surface 42 of the web 30, and a third channel surface 58 that is operable to contact the third side surface 44 of the web 30. The gib 46 includes a first sidewall 60, a second sidewall 62, and a third sidewall 64. The first, second, and third sidewalls 60, 62, 64 of the gib 46 are disposed relative to one another such that the gib 46 is generally U-shaped in a x-y cross-sectional plane. The first sidewall 60 of the gib 46 has a thickness that extends in a lengthwise direction between the first channel surface 54 and a first outer surface 66 of the gib 46. The second sidewall 62 of the gib 46 has a thickness that extends in a lengthwise direction between the second channel surface 56 and a second outer surface 68 of the gib 46. The third sidewall 64 of the gib 46 has a thickness that extends in a widthwise direction between the third channel surface 58 and a third outer surface 70 of the gib 46. The thicknesses of the first, second, and third sidewalls 60, 62, 64 of the gib 46 are all approximately eight millimeters (8 mm) when the gib 46 is in a new condition (e.g., a never used condition). The first and second sidewalls 60, 62 of the gib 46 extend from the third sidewall 64 of the gib 46 in a widthwise direction. The first and second sidewalls 60, 62 of the gib 46 are separated from one another by a lengthwise-extending distance.

The amount of wear experienced by the gib 46 as a result of the above-described contact between the gib 46 and the rail 14 can vary. Referring to FIG. 2, in the illustrated embodiment, the gib 46 is configured such that, during normal operation, the above-described contact between the gib 46 and the rail 14 causes the amount of wear experienced by the gib 46 to increase at a particular rate. That particular rate may be such that the respective thicknesses of the first, second, and third sidewalls 60, 62, 64 of the gib 46 gradually decrease over the course of several years of continuous normal operation. The amount of wear experienced by the gib 46, or one or more portions thereof, can vary depending on the load(s) carried by the elevator car 12. The amount of wear of experienced by the gib 46, or one or more portions thereof, can depend on the alignment of the elevator car 12 (and thus the alignment of the guide device 10) relative to the rail 14. In some embodiments, for example, it is possible that the amount of wear experienced by the gib 46, or one or more portions thereof, will increase at a greater rate when the elevator car 12 is improperly aligned relative to the rail 14 than when the elevator car 12 is properly aligned relative to the rail 14. Similarly, in some embodiments, the rate of wear experience by the gib 46, or one or more components thereof, can depend on a property and/or a quality of the relative materials used.

The point at which the amount of wear experienced by the gib 46 reaches a predetermined threshold can vary. That is, the predetermined threshold can vary. In the embodiment illustrated in FIG. 2, the thicknesses of the first, second, and third sidewalls 60, 62, 64 of the gib 46 are all approximately eight millimeters (8 mm) when the gib 46 is in a new condition, and the predetermined threshold is reached when the thickness of at least one of the first, second, and third sidewalls 60, 62, 64 is approximately five millimeters (5 mm).

The gib 46 can be made from various materials or combinations of materials. Examples of acceptable materials include plastic materials. The material(s) of the gib 46 can be selected such that that, during normal operation, the above-described contact between the gib 46 and the rail 14 causes the amount of wear experienced by the gib 46 to increase at a particular rate. Additionally or alternatively, the material(s) of the gib 46 can be selected such that at least a portion of the gib 46 is electrically non-conductive.

The shoe 48 can be configured in various different ways. Referring to FIG. 2, in the illustrated embodiment, the shoe 48 includes a support portion 72 and a mounting portion 74. The support portion 72 of the shoe 48 has cross-sectional shape that is similar to that of the gib 46. The support portion 72 of the shoe 48 is configured such that the first, second, and third outer surfaces 66, 68, 70 of the gib 46 are operable to be connected thereto. The mounting portion 74 of the shoe 48 includes a plurality of apertures 75 through which bolts (not shown) may be provided to connect the shoe 48 to the elevator car 12. A portion of the shoe 48 is omitted in order to show the second outer surface 68 of the gib 46.

The guide device 10 is configured such that, during normal operation, the shoe 48 does not contact the rail 14. Thus, whereas the gib 46 is operable to contact the rail 14 and is operable to experience an amount of wear as a result of such contact, the shoe 48 is not operable to contact the rail 14. In fact, in some embodiments, contact between the shoe 48 and the rail 14 can cause catastrophic damage to the shoe 48, the rail 14, and/or one or more other components provided within the hoistway 18 (see FIG. 1). In some embodiments, therefore, the gib 46 is intended to function as a sacrificial component of the guide device 10, whereas the shoe 48 is not intended to function as a sacrificial component of the guide device 10.

The shoe 48 can be made from various materials or combinations of materials. Examples of acceptable materials include: steel, iron, and combinations thereof Referring to FIGS. 3 and 4, the wear detector 50 includes a first electrical conductor 76 and a second electrical conductor 78. The first and second electrical conductors 76, 78 can be configured in various different ways. In some embodiments (e.g., FIG. 3), the first electrical conductor 76 is disposed relative to the gib 46, and the second electrical conductor 78 is disposed relative to the rail 14. In other embodiments (e.g., FIG. 4), the first and second electrical conductors 76, 78 are both disposed relative to the gib 46. The configuration of the first and second electrical conductors 76, 78 will be described in more detail below.

The wear detector 50 can operate in various different ways. In some embodiments (e.g., FIG. 3), the wear detector 50 operates by sensing for the existence of an electrical connection between the first and second electrical conductors 76, 78 (e.g., by sensing that a "closed circuit" has been formed at least partially by the first and second electrical conductors 76, 78). In other embodiments (e.g., FIG. 4), the wear detector 50 operates by sensing for the absence of an electrical connection between the first and second electrical conductors 76, 78 (e.g., by sensing that an "open circuit" has been formed at least partially by the first and second electrical conductors 76, 78). In other embodiments, the wear detector 50 can operate by sensing a degree and/or a quality of electrical connectivity between the first and second electrical conductors 76, 78.

As indicated above, in the embodiment illustrated in FIG. 1-3, the wear detector 50 operates by sensing that a "closed circuit" has been formed at least partially by the first and second electrical conductors 76, 78 (see FIG. 3). Referring to FIG. 3, in the illustrated embodiment, the wear detector 50 includes a first electrical conductor 76 disposed relative to the gib 46, a second electrical conductor 78 disposed relative to the rail 14, and a controller 80 that is operable to send and receive electrical signals via the first and second electrical conductors 76, 78. The first electrical conductor 76 includes a first terminal 82 embedded within the second sidewall 62 of the gib 46, and a first wire 84 that extends between the first terminal 82 and the controller 80. The first terminal 82 of the first electrical conductor 76 is embedded within the second sidewall 62 such that, when the gib 46 is in a new condition, a section of the second sidewall 62 of the gib 46 extends between the first terminal 82 and the second channel surface 56 of the gib 46. The second electrical conductor 78 includes a second terminal 86 that is connected to the top end surface 26 of the rail 14, and a second wire 88 that extends between the second terminal 86 and the controller 80. The controller 80 is operable to periodically or continuously send an electrical signal to the first electrical conductor 76. When the gib 46 is in a new condition, the section of the second sidewall 62 that extends between the first terminal 82 and the second channel surface 56 of the gib 46 is operable to prevent the electrical signal from being transmitted from the first electrical conductor 76 to the second electrical conductor 78 (e.g., it prevents an electrical connection between the first and second electrical conductors 76, 78) because the gib 46 is electrically non-conductive. When the gib 46 is in a used condition and the amount of wear experienced by the second sidewall 62 reaches the predetermined threshold (e.g., when the amount of wear is such that the section of the second sidewall 62 that previously extended between the first terminal 82 and the second channel surface 56 has completely worn away, thereby exposing the first terminal 82 to the gib channel 52), the electrical signal sent to the first electrical conductor 76 is transmitted from the first electrical conductor 76 to the second electrical conductor 78 via the rail 14 (e.g., the electrical signal is transmitted via an electrical connection between the first and second electrical conductors 76, 78) because the rail 14 is electrically conductive. The controller 80 is operable to detect that the amount of wear experienced by the gib 46 has reached the predetermined threshold by sensing the presence of an electrical connection between the first and second electrical conductors 76, 78 (e.g., by sensing that a "closed circuit" has been formed at least partially by the first and second electrical conductors 76, 78).

As indicated above, in the embodiment illustrated in FIG. 4, the wear detector 50 operates by sensing that an "open circuit" has been formed at least partially by the first and second electrical conductors. In this embodiment, the wear detector 50 includes a first electrical conductor 76 disposed relative to the gib 46, a second electrical conductor 78 disposed relative to the gib 46, and a controller 80 that is operable to send and receive electrical signals via the first and second electrical conductors 76, 78. The first electrical conductor 76 includes a first terminal 82 embedded within the second sidewall 62 of the gib 46, and a first wire 84 that extends between the first terminal 82 and the controller 80. The second electrical conductor 78 includes a second terminal 86 embedded within the second sidewall 62 of the gib 46, and a second wire 88 that extends between the second terminal 86 and the controller 80. The wear detector 50 further includes an electrically conductive sacrificial element 85 that electrically connects the first terminal 82 and the second terminal 86. The first terminal 82 of the first electrical conductor 76, the second terminal 86 of the second electrical conductor 78, and the sacrificial element 85 are embedded within the second sidewall 62 such that, when the gib 46 is in a new condition, a section of the second sidewall 62 of the gib 46 extends between the second channel surface 56 of the gib 46 and each of the first terminal 82, the second terminal 86, and the sacrificial element 85. The controller 80 is operable to periodically or continuously send an electrical signal to the first electrical conductor 76. When the gib 46 is in a new condition, the electrical signal is transmitted from the first electrical conductor 76 to the second electrical conductor 78 via the sacrificial element 85. When the gib 46 is in a used condition and the amount of wear experienced by the second sidewall 62 reaches the predetermined threshold (e.g., when the amount of wear is such that at least a portion of the sacrificial element 85 has worn away), the electrical signal is no longer transmitted from the first electrical conductor 76 to the second electrical conductor 78. The controller 80 is operable to detect that the amount of wear experienced by the gib 46 has reached the predetermined threshold by sensing the absence of an electrical connection between the first and second electrical conductors 76, 78 (e.g., by sensing that an "open circuit" has been formed at least partially by the first and second electrical conductors).

In another embodiment (not shown) in which the wear detector 50 operates by sensing that an "open circuit" has been formed at least partially by the first and second electrical conductors 76, 78, a first electrical conductor 76 is disposed relative to the gib 46, the second electrical conductor 78 is disposed relative to the rail 14, and the rail 14 is electrically conductive. The first electrical conductor 76 includes an electrically conductive sacrificial portion that is operable to contact the rail 14 and enable an electrical connection between the first and second electrical conductors 76, 78, until the sacrificial portion of the first electrical conductor 76 and the gib 46 experience an amount of wear that reaches a predetermined threshold. Once the predetermined threshold has been reached, the completely worn away sacrificial portion of the first electrical conductor 76 is no longer operable to enable an electrical connection between the first and second electrical conductors 76, 78. In this embodiment, the controller of the wear detector is operable to detect that the amount of wear experienced by the gib 46 has reached the predetermined threshold by sensing the absence of an electrical connection between the first and second electrical conductors 76, 78 (e.g., by sensing that an "open circuit" has been formed at least partially by the first and second electrical conductors 76, 78).

Figure 5:
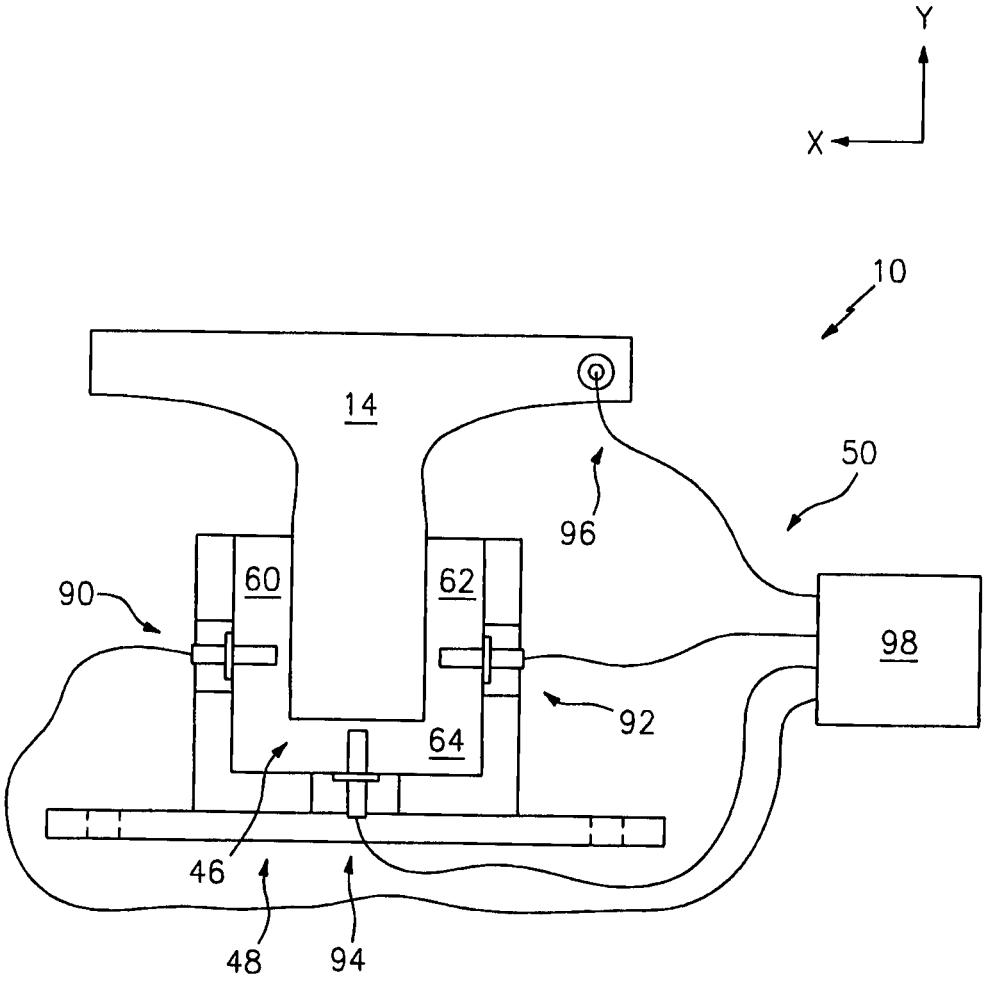
FIG. 5 illustrates a sectional elevation view of another guide device.

Although the wear detector 50 embodiments illustrated in FIGS. 2-4 each include only two electrical conductors (i.e., the first and second electrical conductors 76, 78), in other embodiments the wear detector 50 can include more than two electrical conductors. In the embodiment illustrated in FIG. 5, for example, the wear detector 50 includes first, second, and third electrical conductors 90, 92, 94 disposed relative to the first, second, and third sidewalls 60, 62, 64 of the gib 46, respectively. The wear detector 50 further includes a fourth electrical conductor 96 disposed relative to the rail 14, and includes a controller 98 that is operable to send and receive electrical signals via the first, second, third, and fourth electrical conductors 90, 92, 94, 96. The wear detector 50 operates in a similar manner to the wear detector 50 illustrated in FIGS. 2 and 3. The wear detector 50 is operable to detect when an amount of wear experienced by any one of the first, second, or third sidewalls 60, 62, 64 of the gib 46 reaches a predetermined threshold. This is contrast to the wear detector 50 illustrated in FIGS. 2 and 3, which is only operable to detect when an amount of wear experienced by the second sidewall 62 of the gib 46 reaches a predetermined threshold.

In some embodiments, the wear detector 50, or one or more components thereof, may be adapted to selectively provide a wear threshold signal to indicate that the wear detector 50 has detected that a predetermined threshold has been reached. In such embodiments, the wear threshold signal can be provided to a braking device (not shown) that is operable to stop movement of the elevator car 12 in response to the wear threshold signal. The wear threshold signal can additionally or alternatively be provided to a warning device (not shown) that is operable to warn (e.g., audibly warn, visually warn) maintenance personnel that a predetermined threshold has been reached. The maintenance personnel can infer from the warning that the gib 46 needs to be replaced or repaired in the near or immediate future. In some embodiments, the wear detector 50 can be provided as part of a monitoring system, and can be capable of transmitting monitoring signals and/or alarms to the monitoring system. The wear detector 50 can transmit monitoring signals to the monitoring system wirelessly (e.g., via an internet-based system) and/or via one or more wires. The monitoring system may then keep track of the wear and can take further automated and/or manual actions to ensure the continued operation of the hoisting system 20. The monitoring system can be connected to a remote system that a user may access for remote monitoring. The monitoring system can be connected to the remote system wirelessly (e.g., via an internet-based system) and/or via one or more wires.

The functionality of the wear detector 50, the braking device, and the warning device, can be implemented using hardware, software, firmware, or a combination thereof. For example, the controller 80 of the wear detector 50 can include one or more programmable processors. A person having ordinary skill in the art would be able to adapt (e.g., program) the controller 80 to perform the functionality described herein without undue experimentation. Although the braking device and the warning device are described herein as being separate from the wear detector 50, in some embodiments the braking device and/or the warning device can be implemented as a feature of the wear detector 50.

While several embodiments have been disclosed, it will be apparent to those of ordinary skill in the art that aspects of the present invention include many more embodiments and implementations. Accordingly, aspects of the present invention are not to be restricted except in light of the attached claims and their equivalents. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A guide device operable to be connected to a hoisted object to aid in guiding the hoisted object relative to a guide member, the guide device comprising:

a shoe operable to be connected to the hoisted object;

a gib operable to be connected to the shoe, wherein the gib is operable to contact the guide member when the hoisted object is moved relative to the guide member, and wherein the gib is operable to experience an amount of wear as a result of the contact between the gib and the guide member; and a wear detector disposed relative to the gib and the guide member, the wear detector operable to detect when the amount of wear experienced by the gib reaches a predetermined threshold, and the wear detector including a first electrical conductor, a second electrical conductor and a controller;

wherein the controller is operable to send and receive electrical signals via the first electrical conductor and the second electrical conductor; and wherein the second electrical conductor includes a terminal that is connected to the guide member when the gib is in a new condition; and wherein the gib is operable to contact an electrically conductive portion of the guide member.

2. The guide device of claim 1, wherein the hoisted object is an elevator car.

3. The guide device of claim 1, wherein the guide member is a rail.

4. The guide device of claim 1, wherein the gib is operable to contact an electrically conductive portion of the guide member.

5. The guide device of claim 1, wherein the gib defines a gib channel that is configured to receive a portion of the guide member.

6. The guide device of claim 1, wherein the gib is made at least partially of a plastic material.

7. The guide device of claim 1, wherein the gib is electrically non-conductive.

8. The guide device of claim 1, wherein the shoe does not contact the guide member during normal operation.

9. The guide device of claim 1, wherein the controller is operable to detect when the amount of wear experienced by the gib reaches the predetermined threshold by sensing a presence of an electrical connection between the first electrical conductor and the second electrical conductor.

10. The guide device of claim 9, wherein the controller is operable to detect when the amount of wear experienced by the gib reaches the predetermined threshold by sensing that a closed circuit has been formed at least partially by the first electrical conductor and the second electrical conductor.

11. The guide device of claim 1, wherein the terminal is a second terminal; and the first electrical conductor includes a first terminal embedded within the gib and a first wire that extends between the first terminal and the controller.

12. The guide device of claim 11, wherein the gib defines a gib channel that is configured to receive an electrically conductive portion of the guide member; and wherein the first terminal is embedded within the gib such that, when the gib is in a new condition, a section of the gib extends between the first terminal and a surface of the gib that at least partially defines the gib channel.

13. The guide device of claim 1, wherein the first electrical conductor includes a sacrificial portion that is operable to contact the guide member and enable an electrical connection between the first electrical conductor and the second electrical conductor until the sacrificial portion and the gib experience an amount of wear that reaches the predetermined threshold.

14. The guide device of claim 1, wherein the wear detector is operable to provide a wear threshold signal to indicate that the wear detector has detected that the predetermined threshold has been reached.

15. The guide device of claim 1, wherein the wear detector is operable to provide a wear threshold signal to a braking device that is operable to stop movement of the hoisted object in response to the wear threshold signal.

16. The guide device of claim 1, wherein the wear detector is operable to provide a wear threshold signal to a warning device that is operable to warn a person that the predetermined threshold has been reached.

17. An elevator guidance wear monitoring system, comprising:

a slide guide configured to be operatively mounted to an elevator car, and to selectively contact a guide rail during movement of the elevator car in a hoistway, the slide guide comprising:

a sacrificial liner configured to wear during movement of the elevator car; and a wear monitor configured to identify when wear of the sacrificial liner has reached a predetermined threshold, the wear monitor configured as an electrical monitor comprising a plurality of electrodes;

wherein a first of the electrodes is arranged with the sacrificial liner; and wherein a second of the electrodes is arranged with the guide rail and remotely located from the sacrificial liner.

18. The elevator guidance wear monitoring system of claim 17, wherein the wear monitor is connected to a remote system through an internet-based system.

19. An elevator sliding guide, comprising:

a gib configured to wear away due to sliding contact with a guide rail; and a wear monitoring system configured to provide an electronic indication when the gib has worn away to a predetermined threshold, the wear monitoring system comprising a plurality of electrodes, wherein one of the electrodes is located on the guide rail separate.

20. The elevator sliding guide of claim 19, wherein the electronic indication is provided based on a quality of electrical contact between the plurality of electrodes.

* * * * *